US006267689B1

(12) United States Patent
Ambrose

(10) Patent No.: US 6,267,689 B1
(45) Date of Patent: Jul. 31, 2001

(54) GOLF PUTTER WITH HIGH CENTER OF GRAVITY

(76) Inventor: John A. Ambrose, 8555 Mayfield Rd., Chesterland, OH (US) 44026

( * ) Notice: Subject to any disclaimer, the term of this patent is extended or adjusted under 35 U.S.C. 154(b) by 0 days.

(21) Appl. No.: 09/458,496

(22) Filed: Dec. 11, 1999

Related U.S. Application Data

(60) Provisional application No. 60/113,516, filed on Dec. 18, 1998.

(51) Int. Cl.[7] ..... A63B 53/04; A63B 53/00

(52) U.S. Cl. ..... 473/251; 473/313; 473/328; 473/340; 473/349

(58) Field of Search ..... 473/324, 329, 473/340, 341, 349, 313, 314, 327, 328, 251, 290, 291, 344, 230, 219, 238, 350, 300, 303, 345, 201, 203, 342

(56) References Cited

U.S. PATENT DOCUMENTS

| | | | |
|---|---|---|---|
| Re. 19,178 | * | 5/1934 | Spiker . |
| D. 58,209 | * | 6/1921 | Bacheller . |
| D. 234,960 | | 4/1975 | Swash . |
| D. 234,962 | * | 4/1975 | Swash . |
| D. 244,303 | | 5/1977 | Cabot . |
| D. 248,050 | | 5/1978 | Muehi . |
| D. 268,691 | | 4/1983 | Collins . |
| D. 320,251 | | 9/1991 | Mermillod . |
| D. 340,962 | | 11/1993 | Phillips . |
| D. 354,104 | | 1/1995 | Hardy . |
| D. 364,907 | | 12/1995 | Estridge et al. . |
| D. 367,305 | | 2/1996 | Myers . |
| D. 382,613 | | 8/1997 | Devendorf . |
| D. 395,692 | | 6/1998 | Butler . |
| D. 399,290 | | 10/1998 | Sizemore, Jr. . |
| 2,255,332 | * | 9/1941 | Russell . |
| 2,472,312 | | 6/1949 | Parrish . |
| 2,954,231 | | 9/1960 | MacIntyre . |
| 3,459,426 | * | 8/1969 | Sherwood . |
| 4,121,833 | | 10/1978 | Prueter . |
| 4,795,158 | * | 1/1989 | Kuykendall . |
| 5,058,895 | | 10/1991 | Igarashi . |
| 5,080,365 | | 1/1992 | Winchell . |
| 5,160,141 | | 11/1992 | Crews . |
| 5,211,401 | * | 5/1993 | Hainey . |
| 5,286,027 | * | 2/1994 | Koumarianos . |
| 5,335,913 | | 8/1994 | White . |
| 5,344,149 | * | 9/1994 | Miller . |

(List continued on next page.)

FOREIGN PATENT DOCUMENTS 727051 3/1955 (GB) ..... 273/169

OTHER PUBLICATIONS

Sports Illustrated Aug. 17, 1959, "Pioneer Putters".
Golf Digest Jun. 1970, "First All–New Putter".
Golf World Jan. 4, 1972 "The Arrowhead".
Golf Digest Mar. 1973 "Gondola T" & "Touch".

*Primary Examiner*—Sebastiano Passaniti
(74) *Attorney, Agent, or Firm*—Joseph G. Nauman

(57) ABSTRACT

A golf putter has most of its weight in the upper half of the putter head so the hitting force against a ball is directed horizontally, reducing lift on the ball and causing the ball to roll sooner. A rectangular slot is formed through the center of the putter head, immediately behind the putter face, and is the same width as the diameter of a golf ball so the edge of the ball and the sides of the rectangular slot are integrated by the player's eye to create an alignment used to aim the ball to the hole. The putter shaft and hand grip are stiff to minimize bending action upon contact with the ball. The present grip on the shaft has a generally square cross-section, allowing for a better and consistent fit in the player's hand. The putter preferably incorporates a solid brass head, and also is designed with most of its weight in its upper half to produce a high center of gravity, while conforming to USGA rules.

3 Claims, 2 Drawing Sheets

U.S. PATENT DOCUMENTS 5,346,219 * 9/1994 Pehoski .
5,494,282 2/1996 Pranid .
5,620,379 * 4/1997 Borys .
5,645,493 * 7/1997 Garcia .
5,700,207 12/1997 Guthrie et al. .
5,716,290 2/1998 Baker et al. .
5,749,791 * 5/1998 Passeri .
5,769,738 6/1998 Kershaw et al. .
5,830,078 * 11/1998 McMahan .
6,080,070 * 6/2000 Whitley .

* cited by examiner

GOLF PUTTER WITH HIGH CENTER OF GRAVITY

RELATED APPLICATION

This application is related to U.S. Provisional Patent Application Ser. No. 60/113,516 filed Dec. 18, 1998.

BACKGROUND OF THE INVENTION

The investigation has convinced me that most bad putts are a result of off-center hits on the face of the putter, causing the putter face to torque or turn changing the intended line on which the ball was to roll.

Putter design has been very generic developing a very low center of gravity with most of its weight in the lower half of the putter head. By lofting the face of the putter, the force applied causes the ball to rise before it begins to roll. Hopping and bouncing can cause the ball to go off-line. Putter shafts are usually thinner and softer causing them to bend and then kick or snap, thereby varying the force applied to the ball. This can vary the length of the putt with no way of the person knowing why the putt was long or short.

SUMMARY OF THE INVENTION

The improved putter design of the invention has a rear mounted shaft which enters or attaches to the center of a generally triangular shaped head. There is a rectangular slot cut vertically through the head behind the putter face. The triangular shape and the slot tend to divide and spread the force through the head from the shaft into two locations on the putter face. Since the force is directed away from the center of the putter, the point of incidence (often known as the "sweet spot") is expanded.

The improved design enlarges this point of incidence, minimizing the number of hits which might turn or torque the putter head slightly about the shaft, thus increasing the number of putts that will stay on the intended line.

Since the putter head of this invention is designed with most of its weight in the upper half of the head, the force applied to the ball is in a more horizontal direction, thus reducing the lift on the ball and causing the ball to roll forward sooner, allowing for a truer roll every time. Thus, this putter incorporates a solid brass head which is engineered with most of its weight in its upper half (e.g. above the bottom of the putter front face) to produce a high center of gravity, while conforming to USGA rules.

The rectangular vertically extending slot the putter head is centered behind the front face and is the same width as the diameter of the golf ball. The outside edge of the ball and the sides of the rectangular slot are picked up and integrated by the player's eye to create a line that is used to aim the ball to the hole. Aiming the ball in this way has been found to be easier than trying to create a perfect 90° angle off the putter face. Since the path to the hole is more easily seen, the player's putting accuracy is greatly improved with this design.

The shaft of this putter is extra stiff to reduce another variable that can affect accuracy, namely to eliminate any kick when the putter face engages the ball. It is believed that since putting involves considerable touch and feel, the more consistent the feedback to the player, the more the player can develop his/her touch and improve putting ability.

The design of the grip also is chosen to minimize another variable. Since a person's fingers are segmented at the joints, placing them on a rounded surface can vary their position circumferentially on that surface. The present grip surface is segmented, i.e., it has a generally square cross-section, allowing for a better fit in the hand with the grip corners being engaged with the finger joints, which leads to a more consistent position on that surface. Since placement of the hands on the grip is the contact point to the putter, hand placement consistency should improve accuracy.

DESCRIPTION OF THE DESIGN & PREFERRED EMBODIMENT

Figure 1:
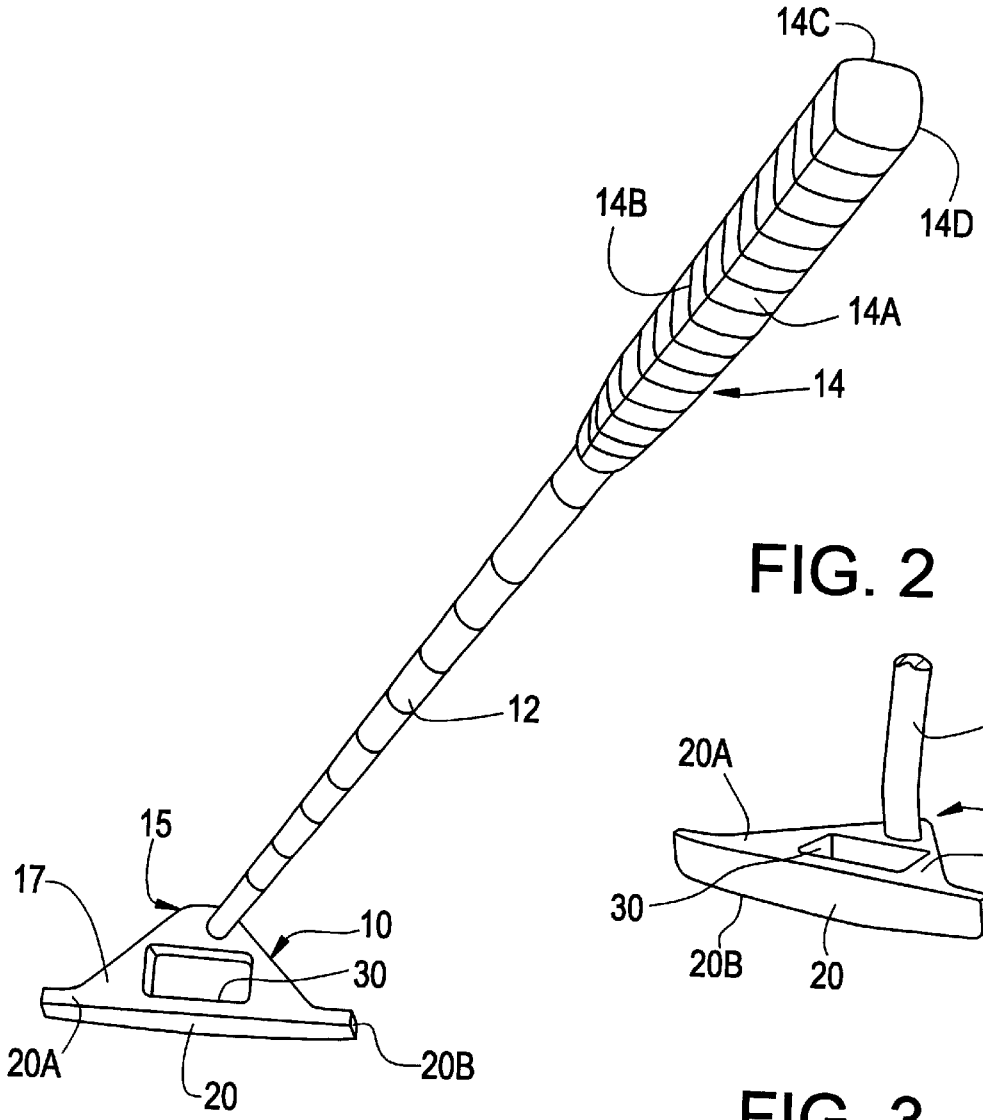
FIG. 1 is an overall perspective view of the improved putter provided by the invention.
Figure 2:
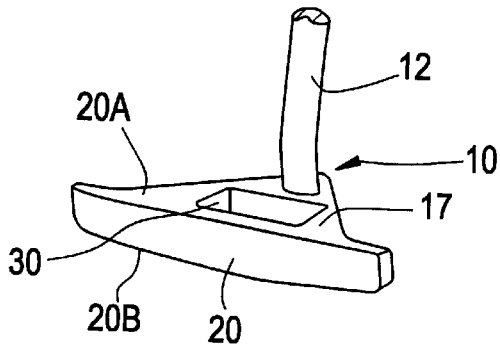
FIGS. 2 and 3 are perspective views of the putter head, as seen from the front looking downward, and from the side and rear looking downward, respectively.
Figure 3:
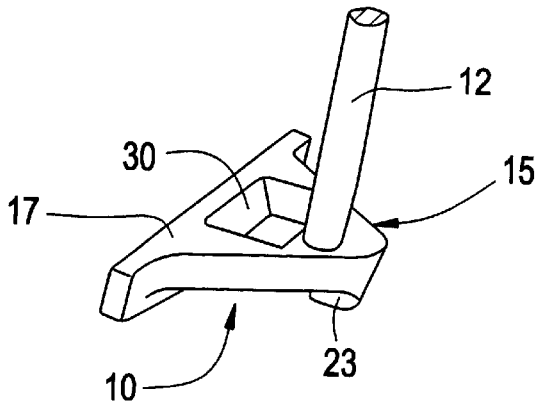
Figure 4:
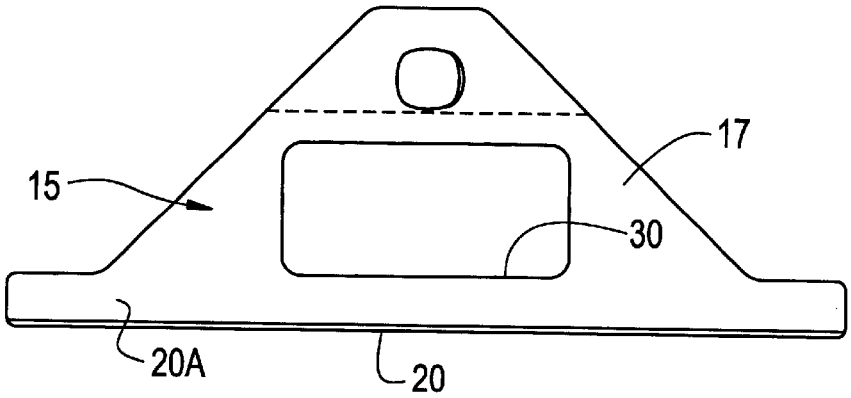
FIG. 4 is an enlarged top view of the head, with the shaft removed.

Referring to FIGS. 1, 2 and 3, the overall novel putter design of the invention has a generally triangular shaped head 10 (as viewed from above) fitted with a rear mounted shaft 12 having a grip 14 at its upper end which is of generally square cross-section having four sides 14A, 14B, 14C & 14D. Shaft 12 enters, and attaches to, the center of head 10 at the rear of the triangular upper section 15 of the head, and extends upward, preferably in a plane parallel to the front face of the head 10, and at an angle of about 20° with respect to the upper surface 17 of head 10.

Head 10 is preferably precision machined from a solid brass block, so the head comprises a triangular upper section 15 with an integral face 20 depending from, and extending laterally outward of, upper section 15, and a smaller pedestal 23 depending from the narrower rear of the upper section 15.

Figure 5:
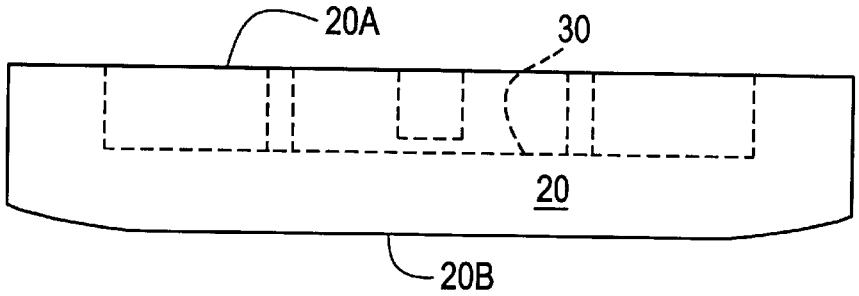
FIG. 5 is a front view of the face of the head, as viewed from the bottom of FIG. 4.
Figure 6:
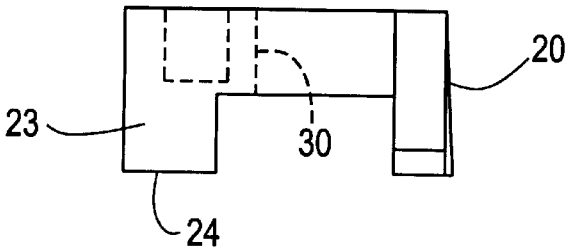
FIG. 6 is a side view of the head, as viewed from the left side of FIG. 4.
Figure 7:
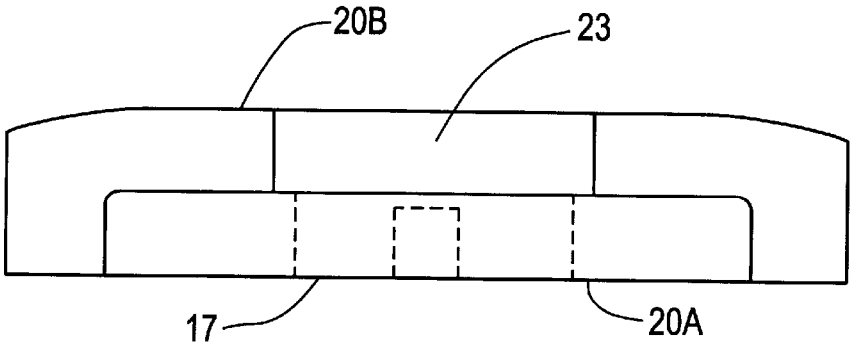
FIG. 7 is an inverted rear view of the head, as viewed from the top of FIG. 4.

Thus head 10 includes a face 20 which depends from the front (wider) edge of triangular upper section 15 (see FIGS. 3 & 6). Preferably, but not necessarily, face 20 is somewhat wider than the remainder of body 10, and the joint of face 20 and the upper body section 15 is flush at its upper edge 20A with the upper surface 17. The vertical plane of face 20 may be slightly tilted from exactly perpendicular to upper surface 17, for example face 20 may extend forward and downward from its upper edge 20A to its bottom edge 20B at an angle in the order of 2°. Also, the face bottom edge 20B may have its ends curved slightly upward, as shown in FIG. 5.

At the back or narrow end of body 15 the depending pedestal 23, which is extends below the under side of the upper body section 15, has a bottom surface 24 spaced from the upper surface 17 by a distance essentially equal to the vertical dimension of face 20 from its bottom edge 20B to its top edge 20A. Thus, when the putter head is placed on the putting surface, ground contact is made by the bottom 20B of the face and the pedestal bottom 24.

Shaft 12 is attached to the narrower end of body 15 on the horizontal front-to-back centerline of head 10, with the square grip 13 aligned such that its sides 14A & 14C are parallel to (and sides 14B, 14D are perpendicular to) that horizontal centerline. Forward of the shaft attachment, a rectangular slot 30 is formed through body 15, immediately behind face 20. When shaft 12 is swung in a forward motion to cause face 20 to hit a ball, the triangular shape of the head and the rectangular shape of slot 25 combine to divide and spread the force directed into head 10 toward two locations on putter face 20, on opposite sides of the horizontal centerline of head 10. Since the force is directed away from the center of the putter, the point of incidence of face 20 against the ball (often known as the "sweet spot") is expanded.

As noted above, the putter of this invention is designed with a major portion of its weight in the upper half of the putter head, e.g. above the lower edge of face 20 and the pedestal 23, so the force applied to the ball is in a more horizontal direction, thus reducing the lift on the hit ball and causing the ball to roll sooner and truer.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A golf putter comprising a shaft with a grip at one of its ends, and a head attached to said shaft at the opposite end thereof from said grip, said head including a body having an upper section with a wider front and narrower rear section, a front face on said front section and depending therefrom, said face having a lower front ground engaging edge, a pedestal depending from said rear section and having a lower rear ground engaging surface corresponding in extension from said body upper section to the lower ground engaging edge of said front face, said central section thereby being elevated above the ground during use of the putter, means defining a slot extending through said upper body section behind said front face and approximately equidistant from the sides of said front face, said slot corresponding in width to the diameter of a golf ball, and said shaft being attached to said rear section and extending upward therefrom, whereby the center of gravity of said head is near the upper surface of said head.

2. A golf putter as defined in claim 1, wherein said upper section of said head is generally triangular.

3. A golf putter as defined in claim 1, wherein said shaft extends upward and toward one side of said head from the center of said narrower rear section.

* * * * *